US010059903B2

(12) United States Patent
Brekan et al.

(10) Patent No.: US 10,059,903 B2
(45) **Date of Patent: *Aug. 28, 2018**

(54) BRANCHED DIESTERS FOR USE AS A BASE STOCK AND IN LUBRICANT APPLICATIONS

(71) Applicant: Elevance Renewable Sciences, Inc., Woodridge, IL (US)

(72) Inventors: Jonathan Brekan, La Grange, IL (US); Jordan Quinn, Mundelein, IL (US); Kyle Mandla, Naperville, IL (US); Ryan Littich, Shorewood, IL (US)

(73) Assignee: Elevance Renewable Sciences, Inc., Woodridge, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/600,468

(22) Filed: May 19, 2017

(65) Prior Publication Data

US 2017/0349856 A1 Dec. 7, 2017

Related U.S. Application Data

(63) Continuation of application No. 14/631,157, filed on Feb. 25, 2015, now Pat. No. 9,683,196.

(60) Provisional application No. 61/947,300, filed on Mar. 3, 2014.

(51) Int. Cl.

| | |
|---|---|
| ***C10M 105/36*** | (2006.01) |
| ***C10M 169/04*** | (2006.01) |
| ***C10M 129/78*** | (2006.01) |
| ***C10M 105/42*** | (2006.01) |

(52) U.S. Cl.

CPC ..... *C10M 169/042* (2013.01); *C10M 105/42* (2013.01); *C10M 129/78* (2013.01); *C10M 169/04* (2013.01); *C10M 2203/1025* (2013.01); *C10N 2220/022* (2013.01); *C10N 2230/02* (2013.01); *C10N 2230/06* (2013.01); *C10N 2230/74* (2013.01); *C10N 2240/10* (2013.01)

(58) Field of Classification Search

CPC ..... C10M 2207/282
USPC ..... 508/496
See application file for complete search history.

(56) References Cited

U.S. PATENT DOCUMENTS

| | | | | |
|---|---|---|---|---|
| 8,575,081 | B2 | 11/2013 | Millet et al. | |
| 2007/0037716 | A1* | 2/2007 | Tamoto | C10M 105/38 508/506 |
| 2009/0054284 | A1 | 2/2009 | Sunkara et al. | |
| 2011/0009300 | A1 | 1/2011 | Elomari et al. | |
| 2012/0053099 | A1 | 3/2012 | Zhou et al. | |
| 2012/0283160 | A1 | 11/2012 | Elomari et al. | |
| 2012/0283161 | A1 | 11/2012 | Jung et al. | |
| 2013/0029891 | A1 | 1/2013 | Okazaki et al. | |

OTHER PUBLICATIONS

Int'l Search Report & Written Opinion of Int'l Searching Authority for PCT App. No. PCT/US2015/017498, dated Jun. 17, 2015.

* cited by examiner

*Primary Examiner* — Vishal Vasisth
(74) *Attorney, Agent, or Firm* — Kilpatrick Townsend & Stockton LLP

(57) ABSTRACT

This application relates to branched diester compositions that can be used as a base stock for lubricant applications, or as a base stock blend component for use in a finished lubricant or for particular applications, and methods for making the same.

8 Claims, 6 Drawing Sheets

Compound 4: octyl 9-(octanoyloxy)decanoate
Compound 5: 10-(octanoyloxy)decan-2-yl octanoate
Compound 6: 2-ethylhexyl 9-(octanoyloxy)decanoate

Compound 4: octyl 9-(octanoyloxy)decanoate

Compound 5: 10-(octanoyloxy)decan-2-yl octanoate

Compound 6: 2-ethylhexyl 9-(octanoyloxy)decanoate

BRANCHED DIESTERS FOR USE AS A BASE STOCK AND IN LUBRICANT APPLICATIONS

CROSS-REFERENCE TO RELATED APPLICATIONS

The present application is a continuation application of U.S. patent application Ser. No. 14/631,157, filed Feb. 25, 2015, now issued as U.S. Pat. No. 9,683,196, which claims the benefit of priority of U.S. Provisional Application No. 61/947,300, filed Mar. 3, 2014. The foregoing provisional application is hereby incorporated by reference as though fully set forth herein in its entirety.

TECHNICAL FIELD

This application relates to branched diester compounds that can be used as a base stock or a base stock blend component for use in lubricant applications, and methods of making the same.

BACKGROUND

Lubricants are widely used to reduce friction between surfaces of moving parts and thereby reduce wear and prevent damage to such surfaces and parts. Lubricants are composed primarily of a base stock and one or more lubricant additives. The base stock may be a relatively high molecular weight hydrocarbon. In applications where there is a large amount of pressure applied to moving parts, lubricating compositions composed only of hydrocarbon base stock tend to fail and the parts become damaged. The lubricant manufacturer is in constant need to improve their formulations to address increased demands on fuel economy while balancing the need to reduce emissions. These demands force manufacturers to address their formulation capabilities and/or look for new base stocks that can meet the performance requirements.

To make lubricants, such as motor oils, transmission fluids, gear oils, industrial lubricating oils, metal working oils, etc., one starts with a lubricant grade of petroleum oil from a refinery, or a suitable polymerized petrochemical fluid. Into this base stock, small amounts of additive chemicals are blended therein to improve material properties and performance, such as enhancing lubricity, inhibiting wear and corrosion of metals, and retarding damage to the fluid from heat and oxidation. As such, various additives such as oxidation and corrosion inhibitors, dispersing agents, high pressure additives, anti-foaming agents, metal deactivators and other additives suitable for use in lubricant formulations, can be added in conventional effective quantities. It has long been known that synthetic esters can be used both as a base stock and as an additive in lubricants. By comparison with the less expensive, but environmentally less safe mineral oils, synthetic esters were mostly used as base oils in cases where the viscosity/temperature behavior was expected to meet stringent demands. The increasingly important issues of environmental acceptance and biodegradability are the drivers behind the desire for alternatives to mineral oil as a base stock in lubricating applications. Synthetic esters may be polyol esters, polyalphaolefins (PAO), and triglycerides found in natural oils. Of key importance to natural oil derived lubricants are physical properties, such as improved low temperature properties, improved viscosity at the full range of operating conditions, improved oxidative stability, and improved thermal stability.

To address this, we have synthesized diester compositions with certain structural properties which address some or all of these physical properties.

DETAILED DESCRIPTION

Figure 1:
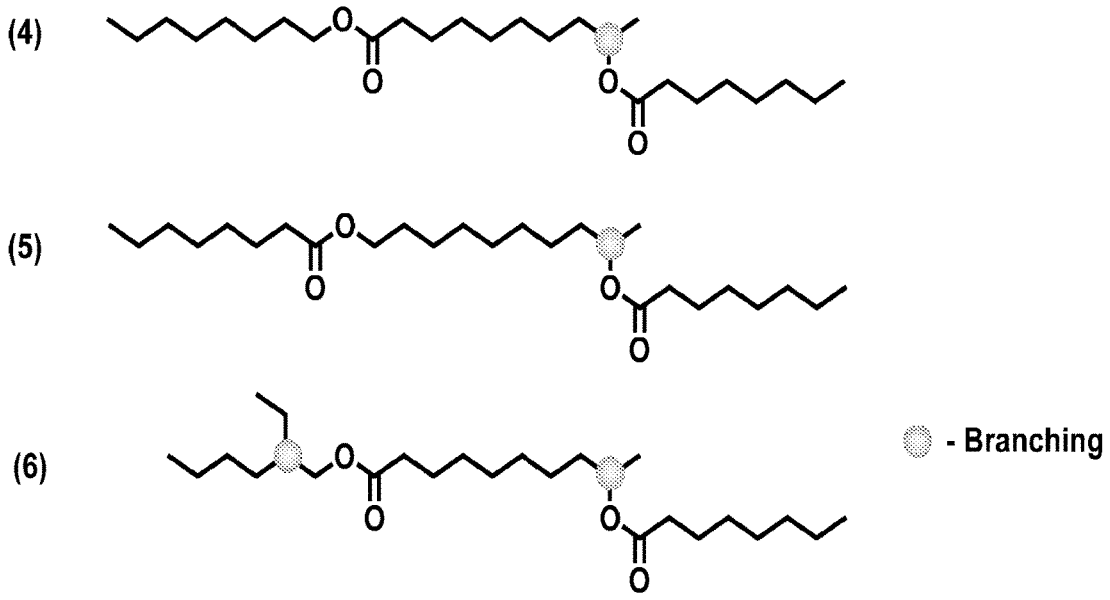
FIG. 1 depicts diesters that have been newly synthesized (compounds 4, 5, and 6).

The present application relates to the compositions and methods for synthesis of diester compounds for use as a base stock for lubricant applications, or a base stock blend component for use in a finished lubricant composition, or for particular applications.

The diesters in accordance with the present embodiments may constitute a lubricant base stock composition, or a base stock blend component for use in a finished lubricant composition, or they may be mixed with one or more additives for further optimization as a finished lubricant or for a particular application. Suitable applications which may be utilized include, but are not limited to, two-cycle engine oils, hydraulic fluids, drilling fluids, greases, compressor oils, cutting fluids, milling fluids, and as emulsifiers for metalworking fluids. The diesters in accordance with the present embodiments may also have alternative chemical uses and applications, as understood by a person skilled in the art. The content of the diesters of the present embodiments may be found neat. In some aspects, finished lubricant compositions may include between about 1 to about 25% by weight of the diester, from about 50 to about 99% by weight of a lubricating base oil, and from about 1 to about 25% by weight of an additive package.

Suitable non-limiting examples of additives may include detergents, antiwear agents, antioxidants, metal deactivators, extreme pressure (EP) additives, dispersants, viscosity modifiers, pour point depressants, corrosion protectors, friction coefficient modifiers, colorants, antifoam agents, demulsifiers and the like.

Suitable base oils can be any of the conventionally used lubricating oils, such as a mineral oil, a synthetic oil, or a blend of mineral and synthetic oils, or in some cases, natural oils and natural oil derivatives, all individually or in combinations thereof. Mineral lubricating oil base stocks used in preparing the greases can be any conventionally refined base stocks derived from paraffinic, naphthenic and mixed base crudes. The lubricating base oil may include polyolefin base stocks, of both polyalphaolefin (PAO) and polyinternal olefin (PIO) types. Oils of lubricating viscosity derived from coal or shale are also useful.

Examples of synthetic oils include hydrocarbon oils such as polymerized and interpolymerized olefins (e.g., polybutylenes, polypropylenes, propyleneisobutylene copolymers); poly(1-hexenes), poly(1-octenes), poly(1-decenes), and mixtures thereof; alkyl-benzenes (e.g., dodecyl benzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, and etherification, constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having a number average molecular weight of 1000, diphenyl ether of polyethylene glycol having a molecular weight of 500-1000, diethyl ether of polypropylene glycol having a molecular weight of 1000-1500) or mono- and polycarboxylic esters thereof, for example, the acetic acid esters, mixed $C_{3-8}$ fatty acid esters, or the $C_{13}$ Oxo acid diester of tetraethylene glycol.

Another suitable class of synthetic lubricating oils that can be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di-(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Esters useful as synthetic oils also include those made from $C_5$ to $C_{12}$ monocarboxylic acids and polyols such as neopentyl glycol, trimethylol propane, and pentaerythritol, or polyol ethers such as dipentaerythritol, and tripentaerythritol.

Silicon-based oils such as the polyalkyl-, polyaryl-, polyalkoxy-, or polyaryloxy-siloxane oils and silicate oils include another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl) silicate, hexyl-(4-methyl-2-pentoxy)disiloxane, poly(methyl)siloxanes, and poly-(methylphenyl)siloxanes). Other synthetic lubricating oils include liquid esters of phosphorus-containing acids (e.g., tricresyl phosphate, trioctyl phosphate, and the diethyl ester of decane phosphonic acid), and polymeric tetrahydrofurans.

Unrefined, refined and re-refined oils, either natural or synthetic (as well as mixtures of two or more of any of these) of the type disclosed hereinabove can be used as the lubricating base oil in the grease composition. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification acts to improve one or more properties. Many such purification techniques are known to those skilled in the art such as solvent extraction, secondary distillation, acid or base extraction, filtration, percolation, re-refined oils are obtained by processes similar to those used to obtain refined oils applied to refined oils which have been already used in service. Such re-refined oils are also known as reclaimed or reprocessed oils and often are additionally processed by techniques directed to removal of spent additives and oil breakdown products.

Oils of lubricating viscosity can also be defined as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80-120 |
| Group II | ≤0.03 | and | ≥90 | 80-120 |
| Group III > | | | | |
| Group IV | All polyalphaolefins (PAOs) | | | |
| Group V | All others not included in Groups I, II, III, or IV | | | |

Groups I, II, and III are mineral oil base stocks. In some embodiments, the oil of lubricating viscosity is a Group I, II, III, IV, or V oil or mixtures thereof.

In one aspect, the diesters were prepared via a two-act route of transesterification and saturated fatty acid addition. In other aspect, the diesters were prepared via a three-act route of transesterification, formic acid addition, and saturated fatty acid addition.

Transesterification is well known to those skilled in the art and can be depicted by the following equation: $RCOOR^1+R^2OH \rightarrow RCOOR^2+R^1OH$. The reactant esters are commonly fatty acid alkyl esters, including $C_5$-$C_{35}$ fatty acid alkyl esters derived from a natural oil. In certain embodiments, the $C_5$-$C_{35}$ fatty acid alkyl esters may be unsaturated alkyl esters, such as unsaturated fatty acid methyl esters. In further embodiments, such esters may include 9-DAME (9-decenoic acid methyl esters), 9-UDAME (9-undecenoic acid methyl esters), and/or 9-DDAME (9-dodecenoic acid methyl esters). The transesterification reaction is conducted at approximately 60-80° C. and approximately 1 atm.

Such fatty acid alkyl esters are conveniently generated by self-metathesis and/or cross metathesis of a natural oil. Metathesis is a catalytic reaction that involves the interchange of alkylidene units among compounds containing one or more double bonds (i.e., olefinic compounds) via the formation and cleavage of the carbon-carbon double bonds. Cross-metathesis may be represented schematically as shown in Equation I:

$$\begin{aligned} R^1{-}CH{=}CH{-}R^2 \leftrightarrow\ & R^1{-}CH{=}CH{-}R^3+R^1{-}CH{=}CH{-}R^4+R^2{-}CH{=}CH{-}R^3+R^2{-}CH{=}CH{-}R^4+R^1{-}CH{=}CH{-}R^1+R^2{-}CH{=}CH{-}R^2+R^3{-}CH{=}CH{-}R^3+R^4{-}CH{=}CH{-}R^4 \end{aligned} \quad (I)$$

wherein $R^1$, $R^2$, $R^3$, and $R^4$ are organic groups.

Self-metathesis may be represented schematically as shown in Equation II below.

$$R^1{-}CH{=}CH{-}R^2+R^1{-}CH{=}CH{-}R^2 \leftrightarrow R^1{-}CH{=}CH{-}R^1+R^2{-}CH{=}CH{-}R^2 \quad (II)$$

wherein $R^1$ and $R^2$ are organic groups.

In particular, self-metathesis of natural oils or cross-metathesis of natural oils with olefins. Suitable olefins are internal or α-olefins having one or more carbon-carbon double bonds, and having between about 2 to about 30 carbon atoms. Mixtures of olefins can be used. The olefin may be a monounsaturated $C_2$-$C_{10}$ α-olefin, such as a monounsaturated $C_2$-$C_8$ α-olefin. The olefin may also include $C_4$-$C_9$ internal olefins. Thus, suitable olefins for use include, for example, ethylene, propylene, 1-butene, cis- and trans-2-butene, 1-pentene, isohexylene, 1-hexene, 3-hexene, 1-heptene, 1-octene, 1-nonene, 1-decene, and the like, and mixtures thereof, and in some examples, α-olefins, such as ethylene, propylene, 1-butene, 1-hexene, 1-octene, and the like. Non-limiting examples of procedures for making fatty acid alkyl esters by metathesis are disclosed in WO 2008/048522, the contents of which are incorporated herein by reference. In particular, Examples 8 and 9 of WO 2008/048522 may be employed to produce methyl 9-decenoate and methyl 9-dodecenoate. Suitable procedures also appear in U.S. Pat. Appl. Publ. No. 2011/0113679, the teachings of which are incorporated herein by reference.

The metathesis catalyst in this reaction may include any catalyst or catalyst system that catalyzes a metathesis reaction. Any known metathesis catalyst may be used, alone or in combination with one or more additional catalysts. Some metathesis catalysts may be heterogeneous or homogenous catalysts. Non-limiting exemplary metathesis catalysts and process conditions are described in PCT/US2008/009635, pp. 18-47, incorporated by reference herein. A number of the metathesis catalysts as shown are manufactured by Materia, Inc. (Pasadena, Calif.).

Cross-metathesis is accomplished by reacting the natural oil and the olefin in the presence of a homogeneous or heterogeneous metathesis catalyst. The olefin is omitted when the natural oil is self-metathesized, but the same catalyst types may be used. Suitable homogeneous metathesis catalysts include combinations of a transition metal halide or oxo-halide (e.g., $WOCl_4$ or $WCl_6$) with an alkylating cocatalyst (e.g., $Me_4Sn$). Homogeneous catalysts may include well-defined alkylidene (or carbene) complexes of transition metals, particularly Ru, Mo, or W. These include first and second-generation Grubbs catalysts, Grubbs-Hoveyda catalysts, and the like. Suitable alkylidene catalysts may have the following structure:

$$M[X^1X^2L^1L^2(L^3)_n]=C_m=C(R^1)R^2$$

where M is a Group 8 transition metal, $L^1$, $L^2$, and $L^3$ are neutral electron donor ligands, n is 0 (such that $L^3$ may not be present) or 1, m is 0, 1, or 2, $X^1$ and $X^2$ are anionic ligands, and $R^1$ and $R^2$ are independently selected from H, hydrocarbyl, substituted hydrocarbyl, heteroatom-containing hydrocarbyl, substituted heteroatom-containing hydrocarbyl, and functional groups. Any two or more of $X^1$, $X^2$, $L^1$, $L^2$, $L^3$, $R^1$ and $R^2$ can form a cyclic group and any one of those groups can be attached to a support.

First-generation Grubbs catalysts fall into this category where m=n=0 and particular selections are made for n, $X^1$, $X^2$, $L^1$, $L^2$, $L^3$, $R^1$ and $R^2$ as described in U.S. Pat. Appl. Publ. No. 2010/0145086 ("the '086 publication"), the teachings of which related to all metathesis catalysts are incorporated herein by reference.

Second-generation Grubbs catalysts may also have the formula described above, but $L^1$ is a carbene ligand where the carbene carbon is flanked by N, O, S, or P atoms, such as by two N atoms. The carbene ligand may be part of a cyclic group. Examples of suitable second-generation Grubbs catalysts also appear in the '086 publication.

In another class of suitable alkylidene catalysts, $L^1$ is a strongly coordinating neutral electron donor as in first- and second-generation Grubbs catalysts, and $L^2$ and $L^3$ are weakly coordinating neutral electron donor ligands in the form of optionally substituted heterocyclic groups. Thus, $L^2$ and $L^3$ are pyridine, pyrimidine, pyrrole, quinoline, thiophene, or the like.

In yet another class of suitable alkylidene catalysts, a pair of substituents is used to form a bi- or tridentate ligand, such as a biphosphine, dialkoxide, or alkyldiketonate. Grubbs-Hoveyda catalysts are a subset of this type of catalyst in which $L^2$ and $R^2$ are linked. A neutral oxygen or nitrogen may coordinate to the metal while also being bonded to a carbon that is α-, β-, or γ- with respect to the carbene carbon to provide the bidentate ligand. Examples of suitable Grubbs-Hoveyda catalysis appear in the '086 publication.

The structures below provide just a few illustrations of suitable catalysts that may be used:

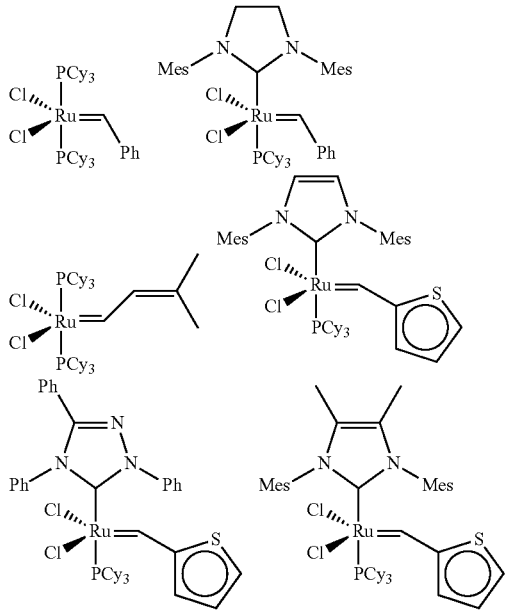

Heterogeneous catalysts suitable for use in the self- or cross-metathesis reaction include certain rhenium and molybdenum compounds as described, e.g., by J. C. Mol in *Green Chem.* 4 (2002) 5 at pp. 11-12. Particular examples are catalyst systems that include $Re_2O_7$ on alumina promoted by an alkylating cocatalyst such as a tetraalkyl tin lead, germanium, or silicon compound. Others include $MoCl_3$ or $MoCl_5$ on silica activated by tetraalkyltins.

For additional examples of suitable catalysts for self- or cross-metathesis, see U.S. Pat. No. 4,545,941, the teachings of which are incorporated herein by reference, and references cited therein. See also *J. Org. Chem.* 46 (1981) 1821; *J. Catal.* 30 (1973) 118; *Appl. Catal.* 70 (1991) 295; *Organometallics,* 13 (1994) 635; *Olefin Metathesis and Metathesis Polymerization* by Ivin and Mol (1997), and *Chem. & Eng. News* 80(51), Dec. 23, 2002, p. 29, which also disclose useful metathesis catalysts. Illustrative examples of suitable catalysts include ruthenium and osmium carbene catalysts as disclosed in U.S. Pat. Nos. 5,312,940, 5,342,909, 5,710,298, 5,728,785, 5,728,917, 5,750,815, 5,831,108, 5,922,863, 6,306,988, 6,414,097, 6,696,597, 6,794,534, 7,102,047, 7,378,528, and U.S. Pat. Appl. Publ. No. 2009/0264672 A1, and PCT/US2008/009635, pp. 18-47, all of which are incorporated herein by reference. A number of metathesis catalysts that may be advantageously employed in metathesis reactions are manufactured and sold by Materia, Inc. (Pasadena, Calif.).

Natural oils suitable for use as a feedstock to generate the fatty acid alkyl esters from self-metathesis or cross-metathesis with olefins are well known. Suitable natural oils include vegetable oils, algal oils, animal fats, tall oils, derivatives of the oils, and combinations thereof. Thus, suitable natural oils include, for example, soybean oil, palm oil, rapeseed oil, coconut oil, palm kernel oil, sunflower oil, safflower oil, sesame oil, corn oil, olive oil, peanut oil, cottonseed oil, canola oil, castor oil, linseed oil, tung oil, jatropha oil, mustard oil, pennycress oil, camellina oil, coriander oil, almond oil, wheat germ oil, bone oil, tallow, lard, poultry fat, fish oil, and the like. Soybean oil, palm oil, rapeseed oil, and mixtures thereof are non-limiting examples of natural oils.

The fatty acid alkyl esters, including the unsaturated fatty acid alkyl esters, are transesterified under conditions known to a person skilled in the art. Such alcohols can be represented by R—OH, where R is the desired ester group, e.g., a shorter chain hydrocarbon, such as a $C_1$-$C_{10}$ hydrocarbon. Such hydrocarbon may include alkyl groups, aryl groups, alkenyl groups, alkynyl groups, which may be linear or branched. In some embodiments, the alcohols may include methanol, ethanol, n-propanol, isopropanol, n-butanol, isobutanol, sec.-butanol, tert.-butanol, pentanol, isoamyl, hexanol, cyclohexanol, heptanol, 2-ethyl hexanol, and octanol.

Suitable catalysts for the transesterification reaction include any acidic, non-volatile esterification catalysts, Lewis acids, Bronsted acids, organic acids, substantially non-volatile inorganic acids and their partial esters and heteropolyacids. Particularly suitable esterification catalysts include alkyl, aryl or alkaryl sulfonic acids, such as for example methane sulfonic acid, naphthalene sulfonic acid, p-toluene sulfonic acid, and dodecyl benzene sulfonic acid. Suitable acids may also include aluminum chloride, boron trifluoride, dichloroacetic acid, hydrochloric acid, iodic acid, phosphoric acid, nitric acid, acetic acid, stannic chloride, titanium tetraisopropoxide, dibutyltin oxide, and trichloroacetic acid. These catalysts may be used in quantities of from about 0.1 to 5 percent by weight of the natural oil starting material.

In some embodiments, the second act is a fatty acid addition that is performed across the double bond(s) of the unsaturated fatty acid alkyl ester. In another embodiment, the third act is a fatty acid addition is performed across the double bond(s) of the unsaturated fatty acid alkyl ester. The fatty acid is a saturated fatty acid, and may be a straight chain or branched acid, and in some examples, a straight chain saturated fatty acid. Some non-limiting examples of saturated fatty acids include propionic, butyric, valeric, caproic, enanthic, caprylic, pelargonic, capric, undecylic, lauric, tridecylic, myristic, pentadecanoic, palmitic, margaric, stearic, nonadecyclic, arachidic, heneicosylic, behenic, tricosylic, lignoceric, pentacoyslic, cerotic, heptacosylic, carboceric, montanic, nonacosylic, melissic, lacceroic, psyllic, geddic, ceroplastic acids.

The reaction of the saturated fatty acid and the unsaturated fatty acid alkyl ester is catalyzed by a strong acid. The strong acid may be a Lewis Acid, a Bronsted acid, or a solid acid catalyst. Examples of such acids include transition metal triflates and lanthanide triflates, hydrochloric acid, nitric acid, perchloric acid, tetrafluoroboric acids, or triflic acid. Acids may include alkyl, aryl or alkaryl sulfonic acids, such as methane sulfonic acid, naphthalene sulfonic acid, trifluoromethane sulfonic acid, p-toluene sulfonic acid, and dodecyl benzene sulfonic acid. Solid acid catalysts may include include cation exchange resins, such as Amberlyst® 15, Amberlyst® 35, Amberlite® 120, Dowex® Monosphere M-31, Dowex® Monosphere DR-2030, and acidic and acid-activated mesoporous materials and natural clays such a kaolinites, bentonites, attapulgites, montmorillonites, and zeolites. These catalysts may be used in quantities of from about 0.1 to 5 percent by weight of the natural oil starting material.

The reaction of the saturated fatty acid and the unsaturated fatty acid alkyl ester yields a diester product and isomer mixtures thereof. One non-limiting reaction scheme for the aforementioned synthesis, using 9-DAME as the unsaturated alkyl ester, is shown below:

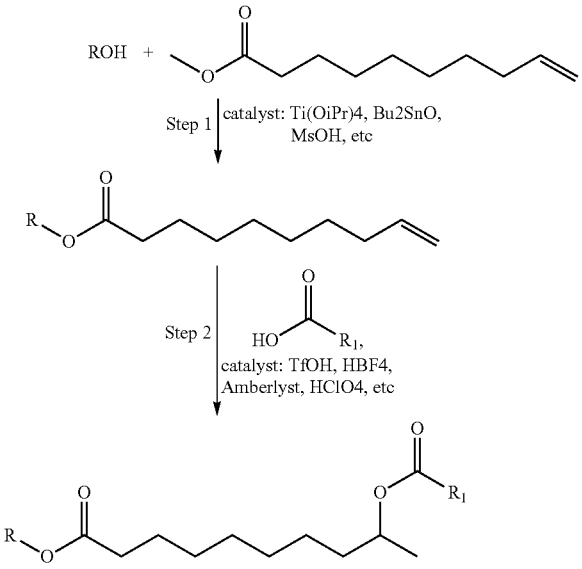

In the above reaction scheme, R and R1 may be one or more of the following: $C_1$-$C_{36}$ alkyl, which may be linear or branched, or hydrogen. Other non-limiting diesters are to be shown in the Examples below.

In some embodiments, the diesters were prepared via a three-act route of transesterification, formic acid addition, and saturated fatty acid addition.

The transesterification conditions were similar to those described above. The second act is the addition of formic acid across the double bond(s) of the unsaturated fatty acid alkyl ester. Formic acid is distinct in the category of linear monocarboxylic acids in that it is approximately ten times more reactive that its higher carbon number analogues. Specifically, formic acid has a pKa value of 3.75, whereas acetic acid and propionic acid have pKa values of 4.75 and 4.87. The significance of the relatively high acidity of formic acid was the addition of formic acid to the unsaturated fatty acid alkyl ester did not require the addition of strong acid catalysts. The omission of strong acid catalysts can lead to improved product quality, and the production of specific structural isomer products. The use of formic acid has other benefits, as in where free hydroxy species are the target compounds, the preparation of formyloxy esters is advantageous. For example, where acetic acid addition adducts are prepared, saponification of the acetyloxy ester would generate a stoichiometric amount of acetate salt waste. Conversely, the saponification of formyloxy esters would yield aqueous alkaline formate salts.

Using 9-decenoic acid methyl ester as a non-limiting example for the unsaturated fatty acid alkyl ester, formic acid was added to yield a formyloxy derivative (9-OCHO-DAME). This derivative then underwent hydrolysis to yield 9-hydroxy decanoic acid methyl ester. A reaction scheme for this process is shown below:

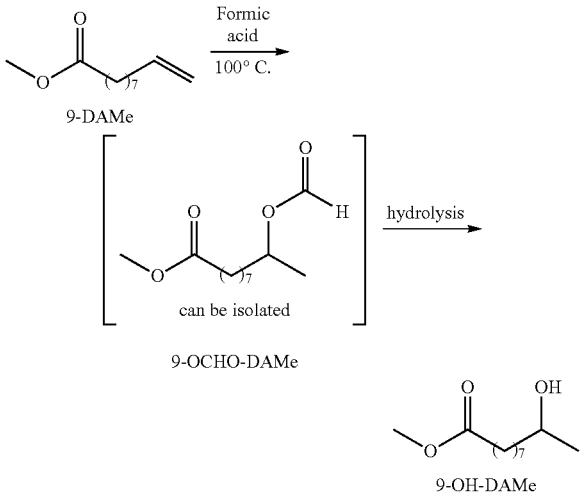

The hydroxyl group of the 9-hydroxy decanoic acid methyl ester is then esterified with a saturated fatty acid and an esterification catalyst. Some non-limiting examples of saturated fatty acids include propionic, butyric, valeric, caproic, enanthic, caprylic, pelargonic, capric, undecylic, lauric, tridecylic, myristic, pentadecanoic, palmitic, margaric, stearic, nonadecyclic, arachidic, heneicosylic, behenic, tricosylic, lignoceric, pentacoyslic, cerotic, heptacosylic, carboceric, montanic, nonacosylic, melissic, lacceroic, psyllic, geddic, ceroplastic acids. The esterification catalysts may be acidic, non-volatile catalysts, Lewis acids, Bronsted acids, organic acids, substantially non-volatile inorganic acids and their partial esters and heteropolyacids. Particularly suitable esterification catalysts include alkyl, aryl or alkaryl sulfonic acids, such as for example methane sulfonic acid, naphthalene sulfonic acid, p-toluene sulfonic acid, and dodecyl benzene sulfonic acid. Suitable acids may also include aluminum chloride, boron trifluoride, dichloroacetic acid, hydrochloric acid, iodic acid, phosphoric acid, nitric acid, acetic acid, stannic chloride, titanium tetraisopropoxide, dibutyltin oxide, and trichloroacetic acid.

Another non-limiting reaction scheme for the aforementioned synthesis, using 9-DAME as the unsaturated alkyl ester, is shown below:

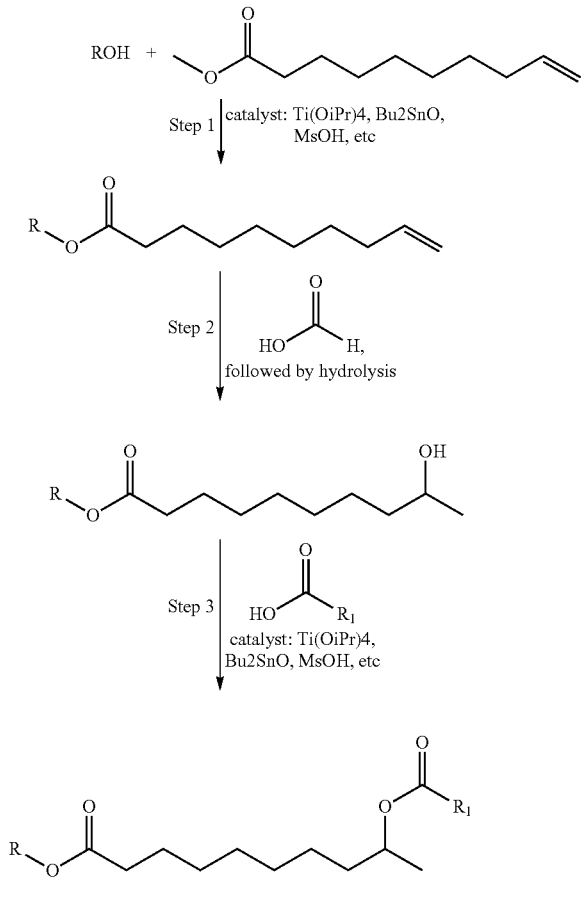

In the above reaction scheme, R and R1 may be one or more of the following: C1-C36 alkyl, which may be linear or branched, or hydrogen.

Other non-limiting examples of the synthesized diesters may include the following structure:

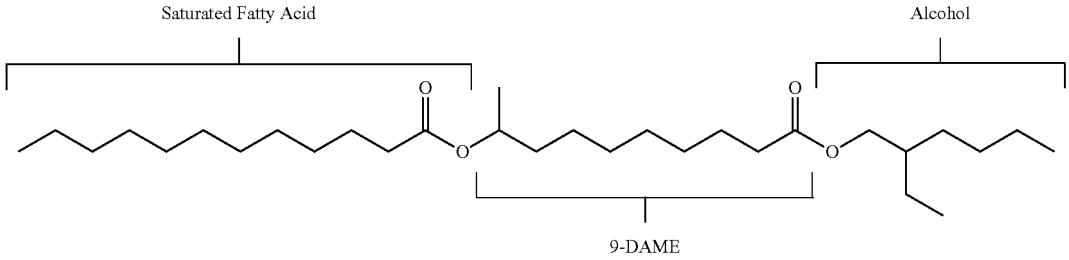

The labels indicate the origin of each component. A shorthand nomenclature can be used to describe these compositions. For the above diester, the composition can be labeled C12/9-DA-2EH, to reference the C12 fatty acid, 9-DAME, and 2-ethyl hexanol.

Another non-limiting structure for the synthesized diesters may include the following structure:

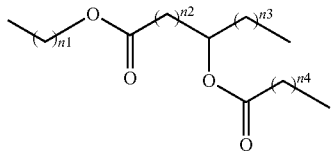

wherein n1 is an alcohol component represented by R—OH, wherein R is a $C_1$-$C_{10}$ hydrocarbon which may be branched or straight chain; wherein n2 is an fatty acid alkyl ester having from $C_5$-$C_{35}$ carbons; wherein n3 is a $C_1$-$C_{36}$ alkyl chain, which may be linear or branched, or hydrogen; and wherein n4 is a branched or straight chain saturated fatty acid having from $C_5$-$C_{35}$ carbons.

Other non-limiting diesters are to be shown in the Examples below, which may include isomers thereof, including cis- and trans-isomers.

EXAMPLES

Acid Value: The acid value is a measure of the total acid present in an oil. Acid value may be determined by any suitable titration method known to those of ordinary skill in the art. For example, acid values may be determined by the amount of KOH that is required to neutralize a given sample of oil, and thus may be expressed in terms of mg KOH/g of oil.

NOACK Volatility (TGA) is a measure of evaporative loss of a lubricating base oil over a period of time. The values reported were measured by ASTM Method ASTM D6375-09

Pour point was measured by ASTM Method D97-96a. Viscosity/kinematic viscosity was measured by ASTM Method D445-97. Viscosity index was measured by ASTM Method D2270-93 (Reapproved 1998).

Preparation of Diester Starting Material—Procedure for Transesterification of 9-DAME Used to Prepare Various Unsaturated Alkyl Esters A 3-neck round bottom flask was fitted with a Dean-Stark trap under a condenser. The reaction vessel was charged with 1.0 molar equivalent of the desired unsaturated fatty acid methyl ester (FAME, e.g. methyl-9-decenoate, methyl-9-dodecenoate), 1.2 molar equivalents of the desired alcohol (e.g. 2-ethylhexanol, 1-octanol, isobutanol), and 10 wt % octanol. The mixture was treated with 0.025 molar equivalents of p-toluenesulfonic acid and the temperature was elevated to 130° C. To aid removal of methanol, the headspace was continuously purged with nitrogen, and the temperature of the reaction mixture was increased 5° C. every 30 minutes until GC-FID indicated that all FAME had been consumed (e.g., ≤4 hour reaction time). The catalyst was quenched with an equal equivalent of KOH in water (0.1 N concentration). The mixture was then phase separated, and the organic phase was washed with water three times (20 g water/100 g reaction mixture), dried with $MgSO_4$, and filtered. The unsaturated esters were purified by distillation; isolated yields may be in the range of 75-90% of the theoretical yield.

Procedure for Preparation of Diesters

In a 2-neck RBF fitted with a heating mantel and stir bar, 1.0 mol equivalents of unsaturated alkyl ester with 1.25 mol equivalents of the saturated fatty acid and 5.0 wt % triflic acid were combined. Reagents were stirred for 18 hours at 60° C., to provide that reaction is absent of water, especially on humid days (hydrolysis of ester can cause many side products). The triflic acid was quenched with an equal molar equivalent of 5 M KOH in water (e.g., If reaction uses 7 mmol TfOH, quench with 7 mmol of KOH in water). Water washing occurred three times, with an effort not to use any brine. A pH strip was used to provide the pH is greater than ~6.5 before distillation (as decomposition may occur). Distillation occurred at <2 Torr (head temperature may be >230° C., pot temp>245° C.). Add a plug of dry basic alumina (0.5"-1" of alumina) to a fritted funnel and filter with a very weak vacuum (~650 Torr). If acid value was >~0.5 mg KOH/g, repeat filtration over the same plug of alumina. Before disposal of the alumina, stirring with 5% EtOAc in Hexanes to release residual diester occurred. This portion can be thoroughly evaporated and then combined with the bulk product. If lower acid numbers are desired, it might be useful to take up the product in hexanes prior to filtration through alumina. There are also a number of products other than basic alumina which are commonly used to reduce acid number by filtration, e.g. Florisil—a magnesium silicate. The isolated yield may be 35-45%.

Example 1—Caprylic Acid

C8:0/2-EH-9-DA

A mixture of 2-ethylhexyl-9-decenoate (≥98%, 200 g, 0.708 mol) and octanoic acid (Sigma Aldrich, ≥98%, 306 g, 2.12 mol) was treated with trifluoromethanesulfonic acid (Sigma Aldrich, 98%, 10 g, 0.067 mol). The mixture was stirred at 60° C. for 18 h. The mixture was cooled to 25° C. and washed with 3×100 mL of saturated aqueous sodium bicarbonate and 100 mL brine. The organic phase was dried over magnesium sulfate and filtered. The product was recovered by vacuum distillation at 210° C.-220° C., 2 Torr; light fractions and bottoms were discarded. The precipitate was removed by vacuum filtration through a fritted funnel to provide 103 g of colorless oil. Physical properties were reported as follows: Kinematic Viscosity (KV) at 100° C. was 3.24 cSt, KV at 40° C. was 12.02 cSt, Viscosity Index (VI) 143, pour point <−45° C., NOACK volatility 15 wt %.

In one particular aspect, the diester is represented by the structure

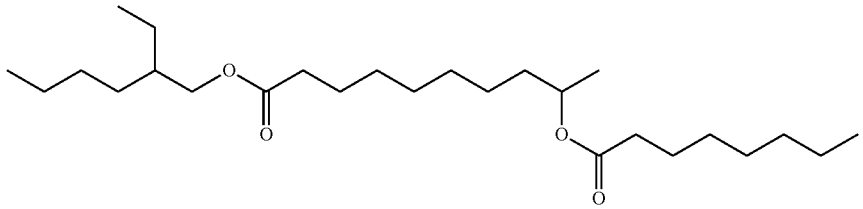

which also may be referred to herein as 2-ethylhexyl 9-(octanoyloxy)decanoate.

C8:0 octyl-9-DA

Octyl-9-decenoate (>98%, 200 g, 0.708 mol) and octanoic acid (Aldrich, ≥98%, 306 g, 2.12 mol) were treated with trifluoromethanesulfonic acid (Sigma Aldrich 98%, 10 g, 0.067 mol). The mixture was stirred at 60° C. for 20 h. At room-temperature, a saturated solution of $NaHCO_3$ (250 mL) was added to the reaction vessel and stirred for 30 minutes. The mixture was transferred to a separatory funnel and phase separated. The organic phase was washed with brine (200 mL×3), dried over $MgSO_4$, and distilled at 234° C., 2 torr. The distillate was washed again with water and dried by rotary evaporation to yield 77 g of clear colorless oil. Physical properties were reported as follows: KV at 100° C. was 3.16 cSt, KV at 40° C. was 11.3 cSt, VI 151, NOACK volatility 10 wt %.

A representative structure of a caprylic acid diester is shown as follows:

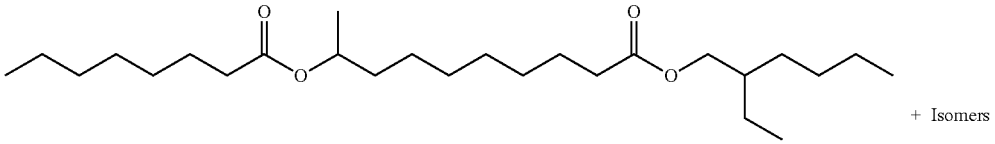

In one particular aspect, the diester is represented by the structure

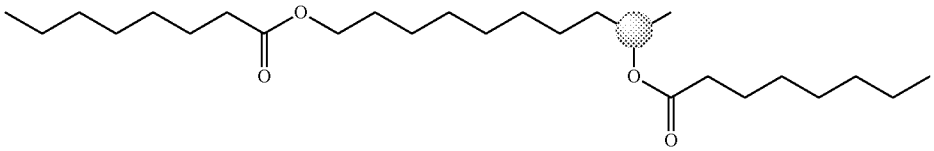

which also may be referred to herein as octyl 9-(octanoyloxy)decanoate.

C8:0/C8:0-1,9-decanediol

9-Hydroxy methyl decanoate ((3:1) 9 hydroxy:8 hydroxy, 10% overall residual 9DAMe) (50 g, 0.25 mol) and tetrahydrofuran (300 mL) were added to a 1 Liter 4-necked round-bottom flask at 23° C. under an atmosphere of air. The flask was then fitted with a magnetic stirbar and thermocouple temperature regulator with heating mantle and nitrogen inlet. Through the headspace of the apparatus was passed $N_2$ (flow rate=2.5 $ft^3$/hr) for 10 minutes, and subsequently, the temperature was lowered to 0° C. by way of ice/water bath. Lithium aluminum hydride was added portion-wise, against positive nitrogen pressure (note: reaction exotherms and hydrogen gas was evolved) The reducing agent was added slow enough to maintain an internal temperature below 60° C. Following addition, the external cooling bath was removed and the reaction is allowed to stir at ambient temperature for 30 minutes. An aliquot was taken for GCFID6 (method oligomer) to evaluate conversion. The reaction was quenched with 1N aqueous HCl (200 mL) and transferred to a separatory funnel. The layers were separated and the organic layer was washed 2× with 50 mL, 1N HCl followed by 100 mL brine. The organic layer was dried with anhydrous magnesium sulfate, filtered via vacuum filtration and concentrated via rotary evaporator (50 Torr, 35° C.) to obtain the crude product as a slight yellow oil. A sample of the crude product was analyzed by 1-H NMR (CDCL3) to reveal the product contained ~10% 9-decenol. The unsaturated alcohol was removed by vacuum distillation through a 12" vigreux column (2 torr, 120° C.) to leave 40 g of the desired diol in the distillation pot, 91% yield ((3:1) 9 hydroxy:8 hydroxy)).

1,9-decanediol ((3:1) 9 hydroxy:8 hydroxy) (30 g, 0.172 mol), octanoic acid (54.6 g, 0.378 mol), methanesulfonic acid (0.5 mL) and toluene (100 mL) were added to a 500 mL 2-necked round-bottom flask at 23° C. under an atmosphere of air. The flask was then fitted with a thermocouple temperature regulator with heating mantle and a Dean-Stark trap with water condenser. The top of the condenser was fitted with a rubber stopper with nitrogen needle inlet. Through the headspace of the apparatus was passed $N_2$ (flow rate=2.5 $ft^3$/hr) for 10 minutes, and subsequently, the temperature was increased to 120° C. and the reaction was stirred at reflux for 6 hours. Approximately 7 mL of water was collected in the trap. The trap was drained and the temperature was increased to 130° C. to remove the remaining toluene and residual water. The heating source was removed and the reaction was allowed to cool to approximate 60° C., passed through a bed of basic alumina oxide and subjected to heat stripping under vacuum (2 torr, 120° C.) for 1 hour. Sample were taken periodically to evaluate conversion and starting material removal. Following stripping, the product was obtained as a slight yellow oil, 66 g (90%) and used without further purification. Physical properties were reported as follows: KV at 100° C. was 3.12 cSt, KV at 40° C. was 11.14 cSt, and VI 150.

In one particular aspect, the diester is represented by the structure:

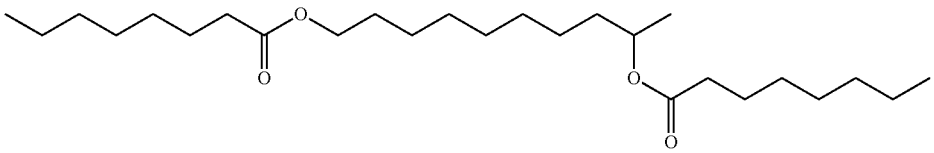

which also may be referred to herein as 10-(octanoyloxy) decan-2-yloctanoate.

Example 2—Capric Acid

C10:0/2-EH-9-DA

A mixture of 2-ethylhexyl-9-decenoate (≥98%, 400 g, 1.42 mol) and decanoic acid (Aldrich, ≥98%, 489 g, 2.83 mol) was treated with trifluoromethanesulfonic acid (20 g, 0.133 mol). The mixture was stirred at 60° C. for 20 h. The mixture was cooled to 25° C. and quenched with 150 mL of 1M KOH which resulted in formation of a precipitate. Water was added to the mixture and stirred rigorously. The resulting emulsion was transferred to a separation vessel and phase separated. The mixture was washed continuously with 5×150 mL H2O. The product was recovered by vacuum distillation at 225° C., 2 Torr; light fractions and bottoms were discarded. Distillation yielded 223.1 g of product as a mixture of isomers, 99% pure by GC-FID. Physical properties were reported as follows: KV at 100° C. was 3.6 cSt, KV at 40° C. was 14.1 cSt, VI 145, pour point <−45° C., NOACK volatility 10 wt %.

C10:0/2-EH-9-DA

A mixture of 2-ethylhexyl-9-decenoate (≥98%, 800 g, 2.83 mol) and decanoic acid (Aldrich, 98%, 490.2 g, 2.84 mol) was treated with trifluoromethanesulfonic acid (Aldrich, ≥98%, 40 g). The mixture was stirred at 60° C. for 20 h. The reaction mixture was then cooled to room temperature and 67 g of $NaHCO_3$ was added. The suspension was stirred continuously for >24 hours, until pH strip indicated pH≥6 (neutralization is also indicated by bleaching of the dark reaction mixture to yellow). The mixture was gravity filtered, and the product was recovered by vacuum distillation at 224° C., 2 Torr; starting materials were recovered as light fractions and the bottoms were discarded. The major fraction was gravity filtered to yield the product as a colorless oil (397 g, 0.87 mol). Light fractions during distillation were combined to provide a 512 g mixture containing 2-ethylhexyl-9-decenoate (69 w % by GC-FID) and decanoic acid (26 w % by GC-FID). The entire quantity was treated with trifluoromethanesulfonic acid (Aldrich, ≥98%, 10 g) and stirred for 18 h at 60° C. At room temperature, the mixture was stirred with $NaHCO_3$ (17 g, 0.2 mol) until pH 6. Purified by vacuum distillation at 224° C., 2 Torr to give the product as a colorless oil (170 g, 0.37 mol). The product fractions obtained over two reactions were combined and purity was verified by GC-FID. Physical properties were reported as follows: KV at 100° C. was 3.6 cSt, KV at 40° C. was 14.0 cSt, VI 146, pour point<−45° C., NOACK volatility 10%.

A representative structure of a caprylic acid diester is shown as follows:

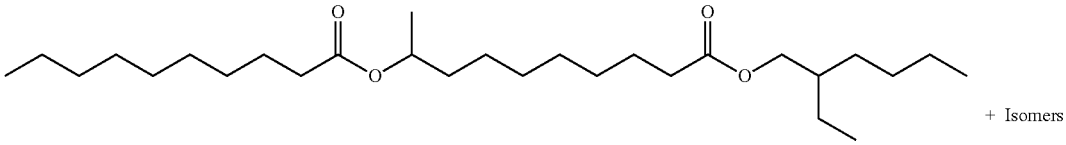

Example 3—Acetoxylation

C2:0/Me-9-DA

A solution of acetic acid (200 g, 3.33 mol) and trifluoromethanesulfonic acid (10 g, 0.067 mol) was treated with methyl-9-decenoate (200 g, 1.085 mol). The mixture was stirred at 60° C. for 20 h. The mixture was placed under vacuum (2 Torr, 60° C.) for 0.5 h to remove excess acetic acid. The reaction mixture was cooled to room temperature and successively washed with 2×100 mL of saturated aqueous sodium bicarbonate and 100 mL brine. The organic phase was dried over magnesium sulfate and filtered. The filtrate was distilled (2 Torr, 115-132° C.) to give 163 g of the product as a clear colorless liquid.

A representative structure of an acetic acid diester is shown as follows:

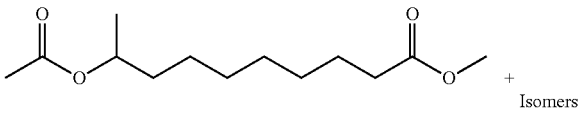

Example 4—Lauric Acid

C12:0/2-ethylhexyl-9-decenoate

A mixture of 2-ethylhexyl-9-decenoate (≥98%, 200 g, 0.708 mol) and dodecanoic acid (Sigma Aldrich, ≥98%, 425 g, 2.12 mol) was heated to 60° C. then treated with trifluoromethanesulfonic acid (Sigma Aldrich, ≥98%, 10 g, 0.067 mol). The reaction was stirred at 60° C. for 22 h. The reaction mixture was then cooled to 45° C. and 100 mL of hexanes was added. The contents of the reaction vessel was transferred to a drop funnel and dodecanoic acid was recrystallized out of solution by dropwise addition of the mixture into isopropanol at −20° C. The resulting suspension was vacuum filtered through Whatman 6 filter paper. The filtrate was concentrated in vacuo and the oil was washed with a 0.1 M aqueous solution of $K_2CO_3$ until pH was 7, then washed with water. The organic phase was dried over $Na_2SO_4$ then purified by vacuum distillation at 218° C., 0.1 Torr to give 69 g of oil. The distillate was passed through a bed of $Al_2O_3$ to give a clear colorless oil. KV at 100° C. was 3.97 cSt, KV at 40° C. was 15.62 cSt, VI 160.6, pour point −40° C., NOACK volatility 5.5 wt %. The synthesized diester may be referred to as 10-[(2-ethylhexyl)oxy]-10-oxodecan-2-yl dodecanoate.

C12:0/iBu-9-decenoate

Isobutyl-9-decenoate (≥98%, 399.2 g) and dodecanoic acid (Sigma Aldrich, ≥98%, 1056 g, 5.3 mol) were combined. The mixture was heated to 60° C. then treated with trifluoromethanesulfonic acid (Sigma Aldrich, ≥98%, 20 g, 0.13 mol). The reaction was stirred at 60° C. for 22 h. Lauric acid was precipitated by dropwise addition of the reaction mixture into a dry ice bath of isopropanol. The suspension was cold-filtered. The filtrate was concentrated in vacuo then transferred into a separatory funnel and washed with water (150 mL×7). The organic phase was dried with $Na_2SO_4$, and purified by distillation. The major fraction was obtained as 292 g of oil at 215° C., 0.1 Torr. The distillate was filtered through basic alumina. KV at 100° C. was 3.35 cSt, KV at 40° C. was 12.24 cSt, VI 154, pour point<−18° C. NOACK volatility 12 wt %.

replaced with a distillation head and receiving flask and the toluene was removed via distillation. Vacuum (2 Torr) and the temperature was increased to 150° C. to remove the excess dodecanoic acid. After 1 hour no more distillate was observed and the crude product was filtered through basic alumina oxide. The product was isolated as a slight yellow oil, 45 g (55%). KV at 100° C. 3.9 cSt, KV at 40° C. 15.78 cSt, VI 157, pour point<−45° C.

Each of the three components of the diester compositions (methyl ester, alcohol, and saturated fatty acid) impart predictable performance qualities on the final structure. Thus, the properties of a diester may be tuned to fit within specific performance specifications by carefully selecting the combination of starting materials. For instance, 9-DDAME based materials may be used to decrease pour point beyond what is possible with 9-DAME based materials, but the increased molecular weight (MW) of 9-DDAME may need to be compensated with a lower MW alcohol or fatty acid if lower viscosities are being targeted. Additionally, lower MW linear alcohols may be used to boost viscosity index and improve NOACK Volatility while decreasing viscosity. The structure property relationships of several combinations are shown in Table 1 and may be used to deduce the properties imparted by individual components.

TABLE 1

| ERS FAME | Alcohol | Saturated Fatty Acid | TGA (%) | Pour Point (° C.) | CCS −30° C. (cPs) | CCS −35° C. (cPs) | KV 100° C. (cSt) | VI |
|---|---|---|---|---|---|---|---|---|
| 9-DDAME | 2-EH | 12:0 | 4.0 | −45 | — | — | 4.6 | 161 |
| 9-DDAME | 2-EH | 12:0 | 5.1 | −45 | — | — | 4.35 | 158 |
| 9-DAME | 2-EH | 12:0 | 5.5 | −40 | 756 | 1278 | 4.0 | 157 |
| 9-DDAME | 2-EH | 10:0 | 6.0 | <−45 | 792 | 1301 | 3.9 | 150 |
| 9-DAME | iBuOH | 12:0 | 12.2 | −18 | — | — | 3.6 | 154 |
| 9-DAME | 2-EH | 10:0 | 10 | <−45 | 655 | 1164 | 3.6 | 145 |
| 9-DAME | 2-EH | 8:0 | 15 | <−45 | — | — | 3.2 | 143 |
| 9-DAME | Octanol | 8:0 | 10 | −37 | — | — | 3.2 | 151 |
| 9-DAME | Hexanol | 8:0 | 18 | <−45 | — | — | 2.8 | 143 |

C10:0/2-ethylhexyl-9-dodecenoate 2-ethylhexyl-9-dodecenoate (≥98%, 416 g, 1.47 mol) and dodecanoic acid (Sigma Aldrich, ≥98%, 357 g, 2.07 mol) were treated with trifluoromethanesulfonic acid (Sigma Aldrich, 98%, 20 g, 0.13 mol) and stirred at 60° C. for 18 h. The reaction was cooled to 25° C. while stirring and the catalyst was quenched within the reaction vessel by dropwise addition of KOH solution (7.5 g KOH in 75 mL $H_2O$). The mixture was transferred to a separatory funnel and phase separated. The organic phase was washed with of DI water (200 mL×2), dried over $MgSO_4$, and filtered. The product was purified by distillation at 224° C., <1 Torr and vacuum filtration through $Al_2O_3$ on a fritted funnel at 650 Torr to yield 230 g of clear yellowish oil. KV at 100° C. 3.9 cSt, KV at 40° C. 15.7 cSt, VI 149, pour point<−45° C., NOACK volatility 6.0 wt %.

C12:0/2-ethylhexyl-9-decenoate

9-OH-2-Ethylhexyldecanoate (50 g, 0.17 mol), dodecanoic acid (40 g), methanesulfonic acid (0.8 g) and toluene (200 mL) were added to a 500 mL 3-necked round-bottom flask at 23° C. under an atmosphere of air. The flask was then fitted with a thermocouple temperature regulator with heating mantle, Dean-Stark distillation trap with water condenser. The top of the condenser was fitted with a rubber stopper with nitrogen needle inlet. Through the headspace of the apparatus was passed $N_2$ (flow rate=2.5 $ft^3$/hr) for 10 minutes, and subsequently, the temperature was increased to 125° C. After approximately 8 hours approximately 3 mL of water was collected in the trap and the Dean-Stark trap was Example 5—Formic Acid Methyl-9-decenoate/formic acid Methyl-9-decenoate (50 g, 0.27 mol) and formic acid (100 mL) were added to a 250 mL 2-necked round bottom flask at 23° C. under an atmosphere of air. The flask was then fitted with a thermocouple temperature regulator with heating mantle and water condenser. The top of the condenser was fitted with a rubber stopper with nitrogen needle inlet. Through the headspace of the apparatus $N_2$ (flow rate=2.5 $ft^3$/hr) for 10 minutes, and subsequently, the temperature was increased to 105° C. After approximately 15 hours, the heating source was removed and the reaction was allowed to cool to ambient temperature. An aliquot was taken for GCMS (method GCMS1) to evaluate conversion. The reaction mixture was transferred to a single-neck round bottom flask and the excess formic acid was removed by rotorary evaporator (50 Torr, 35° C.). 9-OCHO-DAMe was obtained as a slight yellow/brown oil, 60.15 g (97%) and used without further purification.

2-Ethylhexyl 9-decenoate/formic acid

2-Ethylhexyl 9-decenoate (282 g, 1 mol) and formic acid (460 g) were added to a 2 L 3-necked round-bottom flask at 23° C. under an atmosphere of air. The flask was then fitted with a thermocouple temperature regulator with heating mantle and water condenser. The top of the condenser was fitted with a rubber stopper with nitrogen needle inlet. Through the headspace of the apparatus was passed $N_2$ (flow rate=2.5 $ft^3$/hr) for 10 minutes, and subsequently, the temperature was increased to 105° C. After approximately 15 hours, additional formic acid (200 g) was added and the reaction was continued. Following an additional 24 hours the heating source was removed and the reaction was allowed to cool to ambient temperature. An aliquot was taken for GCMS (method GCMS1) to evaluate conversion. The reaction mixture was transferred to a single-neck round bottom flask and the excess formic acid was removed by rotorary evaporator (50 Torr, 35° C.), followed by vacuum distillation (2 Torr, 125° C.). 9-OCHO-2-ethylhexyldecanoate was obtained as a slight yellow/brown oil, 320 g (97%). In a single neck, 1 Liter round-bottom flask was added 9-OCHO-DAEH and 6 M aqueous potassium hydroxide solution. The reaction flask was fitted with a reflux condenser and heated to reflux for 24 hours. The reaction was allowed to cool, the layers were separated and the organic product was dried by vacuum stripping (5 Torr, 100° C.) for 1 hour to obtain the desired 9-OH-2-ethylhexyldecanoate as a slight brown oil, 275 g (91%).

Example 6

FIG. 1 shows some new diesters that have been synthesized. These compounds, 4-6, have the same molecular weight ($C_{26}H_{50}O_4$, 426.68 g/mol) as commercial materials (dioctyl sebacate, 1,10-dioctanoate diester, diethylhexyl sebacate), but have additional points of branching within the backbone of the structure at the ester linkage on the right. Compound 4 may be referred to herein as octyl 9-(octanoyloxy)decanoate. Compound 5 may be referred to herein as 10-(octanoyloxy)decan-2-yl octanoate. Compound 6 may be referred to herein as 2-ethylhexyl 9-(octanoyloxy)decanoate.

Structural analysis of compounds 4 and 5 shows the only difference is the location of the ester linkage on the left. Physical property data for compounds 4-6 are shown in Table 2. The structural difference in compounds 4 and 5 does not distinguish itself in performance. Both materials have low pour points, −33° C., and similar NOACK volatilities, ~10%. These values would allow these materials to be successful in lubricant formulations that could meet the new industry trends. Compound 6 differs from compound 4 by an additional point of branching from the alcohol starting material used to make the ester on the left. This additional point of branching further decreases the pour point, but causes higher evaporative loss.

TABLE 2

| Compound | KV at 100° C. (cSt) | Pour Point (° C.) | NOACK % Loss |
|---|---|---|---|
| 4 | 3.2 | −33 | 10.2 |
| 5 | 3.12 | −33 | 10.6 |
| 6 | 3.2 | −45 | 15 |

We can conclude from this data that when designing low viscosity diesters (~3 cSt, KV100° C.) for lubricant applications, a person skilled in the art should lake into consideration the amount of branching to include in the molecule. For materials of this viscosity, some embodiments have one point of branching. The starting materials for these diesters allows a person skilled in the art to design molecules that will include this unique structural feature.

Figure 2:
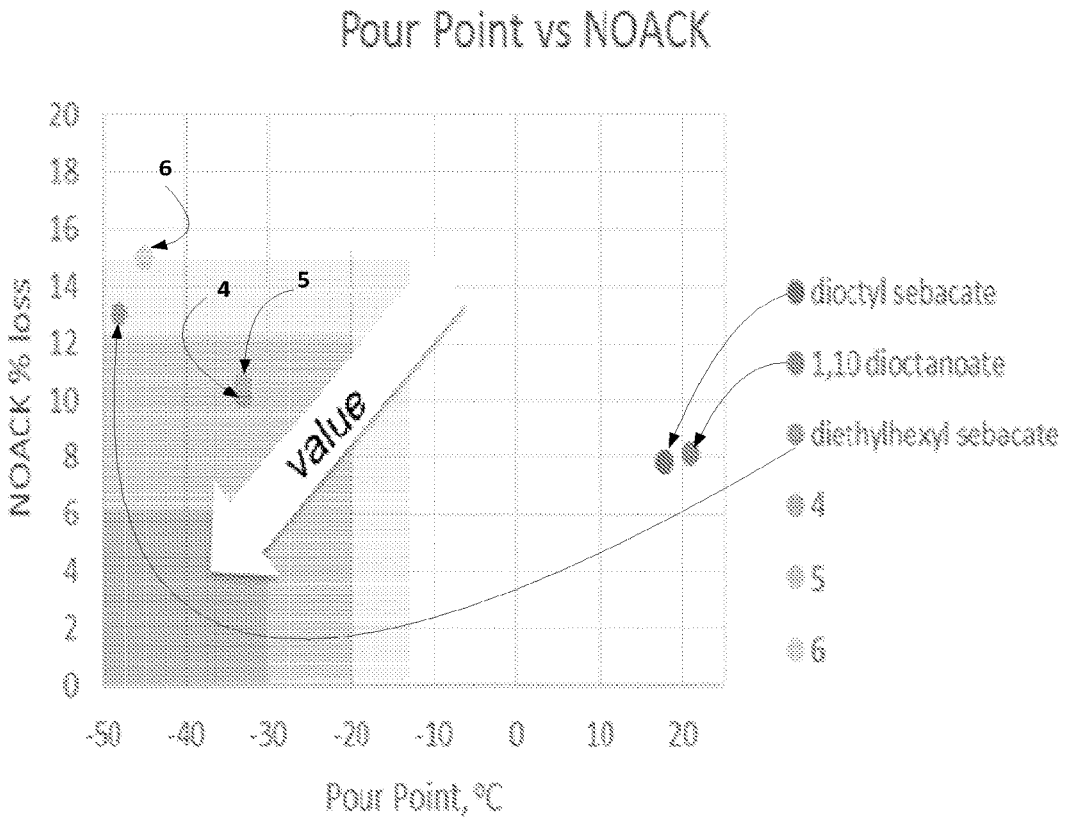
FIG. 2 depicts a cooperative performance diagram that depicts volatility and cold temperature performance of commercial diesters and the newly synthesized compounds 4, 5, and 6.

FIG. 2 is a cooperative performance diagram that depicts volatility and cold temperature performance of commercial diesters and the newly synthesized compounds 4, 5, and 6. The smaller box (far lower left) is desired performance range that the industry would like to see. The medium box (in middle) is the range of required industry performance. The larger box (far upper right) is the borderline performance regime that could be used for other automotive applications. The outlying white area demonstrates inferior performance. One can see that no commercial ester tested falls within the desired performance requirement, and thus, why they are not used currently in automotive crankcase. Due to the structures of our materials, compounds 4 and 5 now fall within the required performance regime and close to the desired performance wishes of the automotive industry. The branched diesters had good low temperature performance (pour point) while maintaining low evaporative loss (% loss—TGA) compared to commercial diesters of similar molecular weights.

Formulation Study

Compounds 4-6 were formulated to 0W20 engine oils and their properties were measured against commercial ester, diethylhexyl sebacate, in the same formulation. In addition, friction testing was performed using a Mini Traction Machine (MTM).

The test materials were formulated at 10 wt %. The formulations utilized an additive package (P6660) of viscosity modifier and pour point depressant, and brought to total volume with Group III mineral oil. The kinematic viscosities of the samples tested all were approximately 8.1 cSt at 100° C. which is representative of a 0W20 grade motor oil. The formulation data is shown in Table 3 below.

TABLE 3

Formulation Data

| Compound | Diester Component, 10% | add-pack (P6660) | KV100° C., cSt |
|---|---|---|---|
| 3 | Diethylhexyl sebacate | 13.3% | 8.1 |
| 4 | C8:0/1-octyl-9-decenoate | 13.3% | 8.1 |
| 5 | C8:0, C8:0-1,9-decanediol | 13.3% | 8.1 |
| 6 | C8:0/2-ethylhexyl-9-decenoate | 13.3% | 8.1 |

3.5% VM
0.2% PPD
73% Group III base oil (Ultra S-4)

TGA—Volatility

Evaporative loss results in thickening of the overall lubricant which results in sub-standard performance. In addition, the materials that evaporated have now passed by the piston rings on the cylinder head into the combustion chamber. These materials will be decomposed into materials that could either leave deposits on the piston head creating friction points, or will be passed through the exhaust manifold potentially poisoning the catalytic converter. Lubricants are designed with evaporative loss in mind. The results below demonstrate the bulk volatility of a lubricant formulated with the synthesized diesters compared to a commercial diester.

The formulated samples were tested for evaporative loss using the Thermal Gravimetric Analysis protocol ASTM D6375. The evaporative loss determined by this test method is the same as that determined using the standard Noack test methods.

Figure 3:
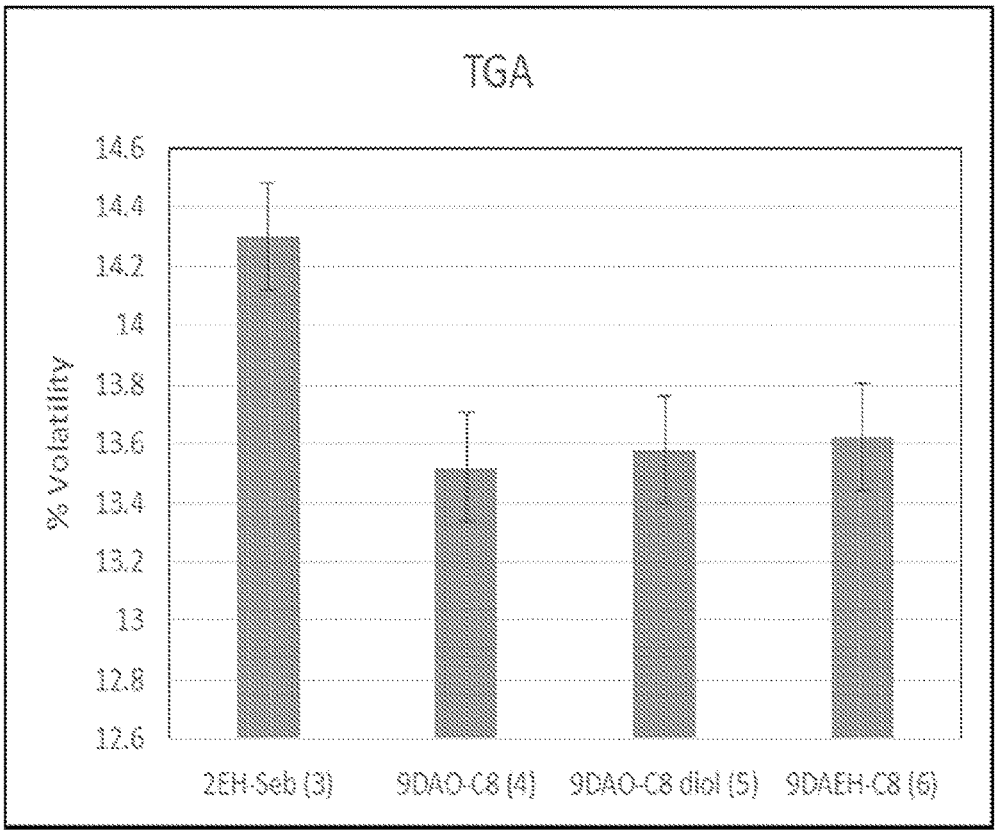
FIG. 3 depicts the TGA volatility of a commercial diester and the newly synthesized compounds 4, 5, and 6 in an engine oil lubricant formulation.

The data depicted in FIG. 3 show that Compound 3 demonstrated higher evaporative loss compared to the other samples. Although, not significantly differentiated, the trend of branched diesters (Compounds 4-6) does show clearly a performance advantage versus the commercial ester in formulation. The most interesting data within is the lubricant that was formulated with Compound 6. Compound 6 demonstrated the highest Noack % loss as a neat oil, 15%.

Cold Crank Simulator

Figure 4:
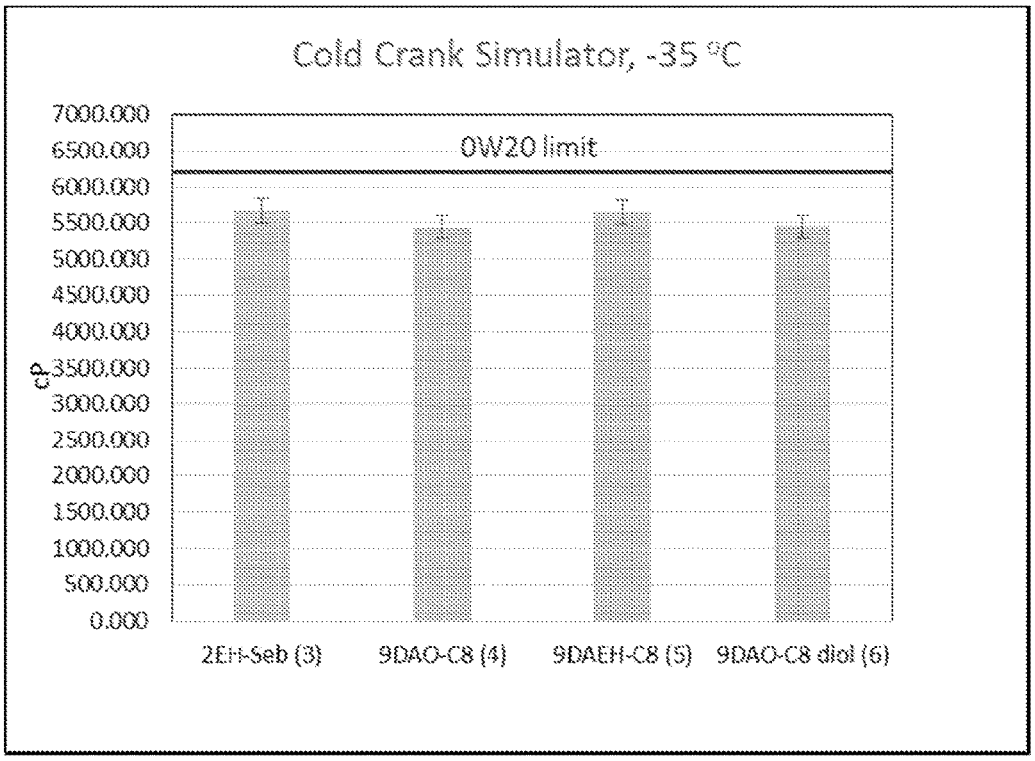
FIG. 4 depicts the cold crank simulator performance of a commercial diester and the newly synthesized compounds 4, 5, and 6.

The cold-cranking simulator (CCS) was designed test for determining the low temperature performance of lubricants, in the specific condition of "cold cranking"—i.e. starting a cold engine. For a lubricant to pass as 0W20 grade lubricant, the CCS value as measured at 31 35° C. is less than 6200 mPa·s (cP). The utilization of solely group III mineral oils for passenger car motor oils has a difficult time passing these demanding levels. Formulators have been relying on pour point depressants and/or co-basestocks to achieve these low temperature requirements. We have formulated all of the test samples to the same amount of diester. As depicted in FIG. 4, the results show all formulations provided CCS values lower than the limit allowable for a 0W20 grade engine oil. There were no appreciable differences between the data base on standard deviation. This data clearly shows that branched diesters can be used as co-basestocks for low viscosity engine oils.

Coefficient of Friction—MTM

Figure 5:
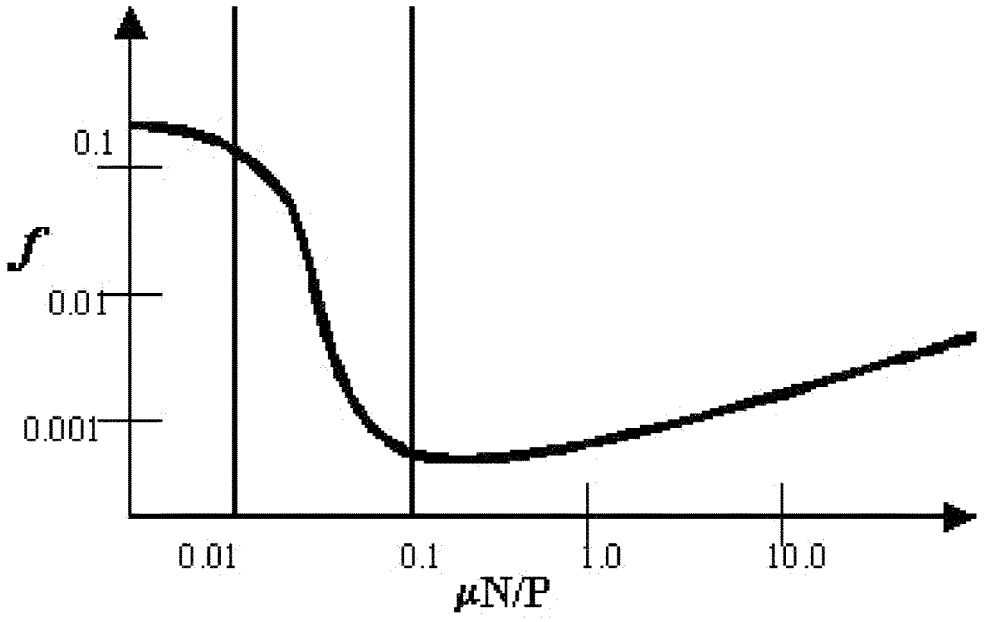
FIG. 5 depicts a Stribeck Curve, which plots the relationship between friction and viscosity, speed, and load.

The primary function of a lubricant is to provide protection for moving parts, thereby reducing friction and wear of the machine. Cooling and debris removal are the other important benefits provided by a fluid lubricant. The Stribeck Curve, depicted in FIG. 5, is a plot of the friction as it relates to viscosity, speed and load. On the vertical axis is the friction coefficient. The horizontal axis shows a parameter that combines the other variables: μN/P. In this formula, μ is the fluid viscosity, N is the relative speed of the surfaces, and P is the load on the interface per unit bearing width. As depicted in FIG. 5, as you move to the right on the horizontal axis, the effects of increased speed, increased viscosity or reduced load are seen.

As stated earlier, the viscosity of the lubricant is important. From the horizontal parameter above the fluid viscosity is in direct correlation to the friction observed at a particular speed and applied force. Therefore, when comparing multiple samples maintaining similar viscosities allows the experimenter to correlate friction to individual components within the formulation. In our case, we have kept the level of the diester exactly the same, yet changed the molecular structure in hopes to glean a structure-activity profile as it pertains to the friction observed.

We utilized a Mini Traction Machine (PC Instruments) to measure the friction coefficient of lubricants. The experiment was set up to run at 150° C. to mimic full running speed of an engine. During ultra-high speeds and temperatures the fluid film can thin and allow for minor metal contact. This is becoming a common phenomenon in lubricant development for passenger car motor oils (e.g., 5 W and 0 W grades). We have chosen to formulate a 0W20 grade motor oil to understand if the structure of the diester has any influence on the frictional properties of the bulk lubricant.

Figure 6:
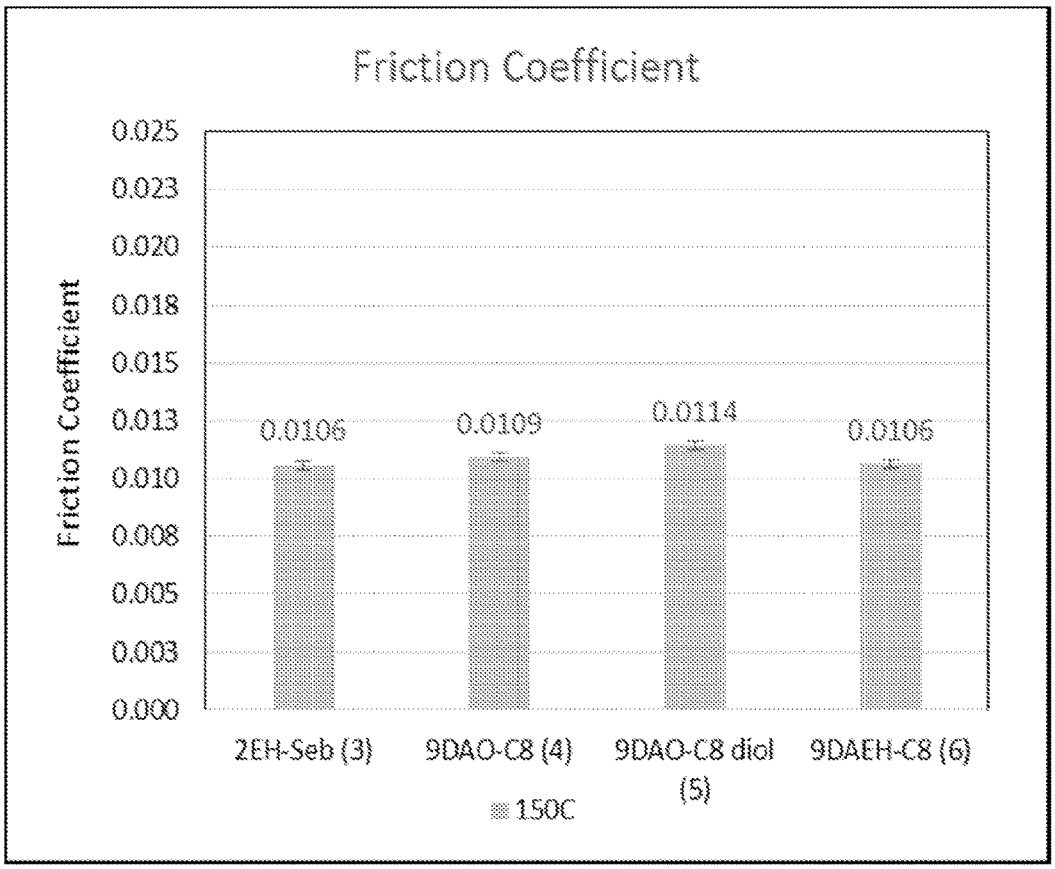
FIG. 6 depicts the friction coefficient data of a commercial diester and the newly synthesized compounds 4, 5, and 6.

FIG. 6 shows the average coefficient of friction data for the lubricants containing Compounds 3-6. The coefficient of friction was similar for all lubricants. From this preliminary data it shows that the structure of the diester does not correlate to the coefficient of friction under these conditions.

To recap the formulation study, a series of low viscosity, branched diesters (Compounds 4-6) were synthesized for use in passenger car motor oil formulations. The bulk properties of the neat oils were compared to commercial diesters of identical molecular formulas and weights. The physical data was measured to determine if there were structure-performance relationships that could be realized. Initial results showed diesters with two points of branching have higher overall volatility levels but lower pour point levels.

Additionally, these neat diesters were formulated to 0W20 grade engine oils and the same physical properties were measured, as well as coefficient of friction. Interestingly, all of the diesters (Compounds 4-6) showed similar TGA volatilities compared to the commercial diester, Compound 3. Cold crank simulator and coefficient of friction data showed parity against the commercial diester.

Ultimately, the branched diesters can be formulated to low viscosity motor oils for passenger car applications. The level of branching in the diester is important to know as it has an effect on volatility and pour point as neat oils.

The foregoing detailed description, examples, and accompanying figures have been provided by way of explanation and illustration, and are not intended to limit the scope of the invention. Many variations in the present embodiments illustrated herein will be apparent to one of ordinary skill in the art, and remain within the scope of the invention and their equivalents. The skilled person in the art will recognize many variations that are within the spirit of the invention and scope of any current or future claims.

The invention claimed is:

1. A method of making a diester lubricant base stock compound, comprising:

reacting methyl 9-decenoate with an alcohol of formula R—OH, wherein R is a $C_1$-$C_{36}$ alkyl group, to form a monoester, wherein the monoester is a compound of formula

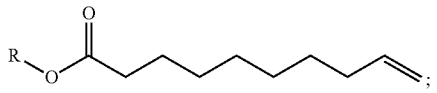

and reacting the monoester with an acid of formula $R_1$—COOH, wherein $R_1$ is a $C_1$-$C_{36}$ alkyl group, to form a diester lubricant base stock compound of formula

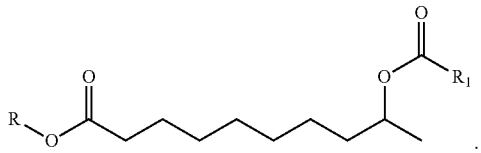

2. The method of claim 1, wherein R is 2-ethylhexyl, isobutyl, n-hexyl, or n-octyl.

3. The method of claim 1, wherein $R_1$ is n-heptyl, n-nonyl, or n-undecyl.

4. The method of claim 2, wherein $R_1$ is n-heptyl, n-nonyl, or n-undecyl.

5. A method of making a diester lubricant base stock compound, comprising:

reacting methyl 9-decenoate with an alcohol of formula R—OH, wherein R is a $C_1$-$C_{36}$ alkyl group, to form a first monoester, wherein the monoester is a compound of formula

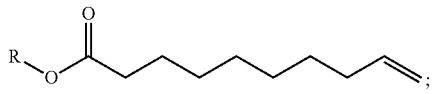

reacting the first monoester with formic acid, followed by hydrolysis, to form a second monoester, wherein the second monoester is a compound of formula

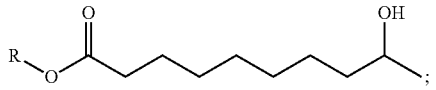

and reacting the second monoester with an acid of formula $R_1$—COOH, wherein $R_1$ is a $C_1$-$C_{36}$ alkyl group, to form a diester lubricant base stock compound of formula

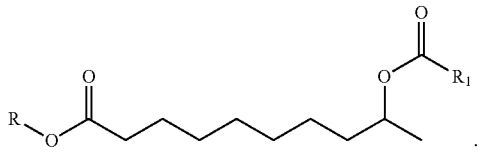

6. The method of claim 5, wherein R is 2-ethylhexyl, isobutyl, n-hexyl, or n-octyl.

7. The method of claim 5, wherein $R_1$ is n-heptyl, n-nonyl, or n-undecyl.

8. The method of claim 6, wherein $R_1$ is n-heptyl, n-nonyl, or n-undecyl.

* * * * *